US008182315B2

(12) United States Patent
Nguyen

(10) Patent No.: US 8,182,315 B2
(45) Date of Patent: May 22, 2012

(54) CHEMICAL MECHANICAL POLISHING PAD AND DRESSER

(76) Inventor: Phuong Van Nguyen, San Jose, CA (US)

( * ) Notice: Subject to any disclaimer, the term of this patent is extended or adjusted under 35 U.S.C. 154(b) by 868 days.

(21) Appl. No.: 12/054,018

(22) Filed: Mar. 24, 2008

(65) Prior Publication Data

US 2009/0239456 A1 Sep. 24, 2009

(51) Int. Cl.
*B24B 53/00* (2006.01)

(52) U.S. Cl. ..... 451/72; 451/443

(58) Field of Classification Search ..... 451/270, 451/443, 444, 56, 72
See application file for complete search history.

(56) References Cited

U.S. PATENT DOCUMENTS

| | | | | |
|---|---|---|---|---|
| 2,794,303 | A * | 6/1957 | Wickes | 451/357 |
| 4,165,584 | A | 8/1979 | Scherrer | |
| 4,512,113 | A | 4/1985 | Budinger | |
| 4,962,618 | A | 10/1990 | Wylde | |
| 5,456,627 | A * | 10/1995 | Jackson et al. | 451/11 |
| 5,573,448 | A | 11/1996 | Nakazima et al. | |
| 5,647,789 | A | 7/1997 | Kitta | |
| 5,788,560 | A | 8/1998 | Hashimoto et al. | |
| 6,331,136 | B1 * | 12/2001 | Bass et al. | 451/56 |
| 6,612,905 | B2 | 9/2003 | Nguyen | |
| 6,645,049 | B2 | 11/2003 | Nguyen | |
| 6,666,948 | B2 | 12/2003 | Nguyen | |
| 6,733,367 | B1 | 5/2004 | Nguyen | |
| 7,597,608 | B2 * | 10/2009 | Chang et al. | 451/56 |
| 2003/0036341 | A1 * | 2/2003 | Myoung et al. | 451/41 |
| 2007/0281592 | A1 * | 12/2007 | Benner | 451/72 |

* cited by examiner

*Primary Examiner* — Robert Rose
(74) *Attorney, Agent, or Firm* — Michael I. Kroll

(57) ABSTRACT

The present invention discloses a Chemical Mechanical Polishing (CMP) pad dresser used in lapping and polishing silicon wafers in either single or double sided polishing machines.

20 Claims, 9 Drawing Sheets

CHEMICAL MECHANICAL POLISHING PAD AND DRESSER

BACKGROUND OF THE INVENTION

1. Field of the Invention

The present invention relates generally to wafer polishing and, more specifically, to a Chemical Mechanical Polishing (CMP) pad dresser used in lapping and polishing silicon wafers in either single or double sided polishing machines.

Chemical Mechanical Polishing (CMP) is a process that is used for the planarization of semiconductor wafers. CMP takes advantages of the synergetic effect of both physical and chemical forces for polishing of wafers. This is done by applying a load force to the back of a wafer while it rests on a pad. Both the pad and wafer are then counter rotated while a slurry containing both abrasives and reactive chemicals is passed underneath.

The goal of CMP is to obtain uniform planarization globally across the wafer. The wafers consist of many small dies and patterns, which take the form of interconnected lines of copper and silica. Planarization occurs when the interconnects are polished to the point where both the copper and the silica lines are at the same level.

CMP has emerged as the dominant dielectric planarization method due to its ability to reduce topography over longer lateral distances than earlier techniques. However, CMP still suffers from pattern dependencies that result in large variation in polished oxide thickness across typical chips, which can impact circuit performance and yield. The present invention improves upon CMP process resulting in improved planarization and thus improved performance and higher yield.

The present invention is a chemical mechanical polishing pad dresser, conditioners or groomers consisting of several integrated pieces and design components, layered in a sandwich type design.

The apparatus of the present invention consists of a bottom layer of fiberglass or other suitable material with round cavities or pockets machined into the surface of the material in various patterns and a top layer of the same material with holes matching the locations of the bottom layer cavities or pockets. The bottom layer has double side glue tape applied with a protective backing shield that is peeled off at mounting, thus allowing the tool to be easily attached to the polishing machine head or carrier. The matching round holes in the top layer are of slightly smaller diameter than the bottom layer cavities to permanently hold or contain the spinning islands or discs in the cavities upon assembly of the various layers. Mylar shims are placed in the bottom layer cavities and the spinning polishing islands are placed in the cavities or pockets on top of the shims. The shims facilitate the spinning of the polishing discs or islands, which are slightly less diameter that the cavity diameters to further facilitate the spinning feature. The top layer with the machining holes is glued to the bottom layer, thereby permanently containing the spinning islands in the pockets or cavities.

The round layers are designed and may be suited to the same diameter as any polishing machine head and can be utilized by either single or double sided polishing machines.

2. Description of the Prior Art

There are other methods and apparatuses for polishing silicon wafers. Typical of these is U.S. Pat. No. 4,165,584 was issued to Scherrer on Aug. 28, 1979

Another patent was issued to Budinger on Apr. 23, 1985 as U.S. Pat. No. 4,512,113. Yet another U.S. Pat. No. 5,647,789 was issued to Kitta on Jul. 15, 1997 and still yet another was issued on Oct. 16, 1990 to Wydle as U.S. Pat. No. 4,962,618.

Another patent was issued to Nakazima on Nov. 12, 1996 as U.S. Pat. No. 5,573,448. Yet another U.S. Pat. No. 5,788,560 was issued to Hashimoto on Aug. 4, 1998. Another was issued to Nguyen on Sep. 2, 2003 as U.S. Pat. No. 6,612,905

Still yet another was issued on Nov. 11, 2003 to Nguyen as U.S. Pat. No. 6,645,049. Another patent was issued to Nguyen on Dec. 23, 2003 as U.S. Pat. No. 6,666,948. Yet another U.S. Pat. No. 6,733,367 was issued to Nguyen on May 11, 2004.

U.S. Pat. No. 4,165,584

Inventor: Scherrer

Issued: Aug. 28, 1979

Wafers to be processed are mounted to a lapping plate of a lapping machine using a photosensitive thermoplastic material, such as a photoresist. In a preferred embodiment, the wafers are laminated to a dry film photopolymer disposed on a carrier sheet, after which the sheet is secured to the lapping plate using a pressed-fit hoop that stretches the carrier sheet across the surface of the lapping plate and holds the sheet secure about the perimeter of the plate.

U.S. Pat. No. 4,512,113

Inventor: Budinger

Issued: Apr. 23, 1985

The workholder includes a carrier to which a flat perforated template is removably secured. An insert is removably mounted in each hole and removably supports a silicon wafer to facilitate polishing the wafer.

U.S. Pat. No. 4,962,618

Inventor: Wylde

Issued: Oct. 16, 1990

A lens lapping pad comprising a zinc alloy foil having a thickness of about 0.1 mm, and a backing of cloth impregnated with a pressure sensitive adhesive, to give an overall pad thickness of about 0.5 mm. A peelable cover may protect the cloth backing.

U.S. Pat. No. 5,647,789

Inventor: Kitta

Issued: Jul. 15, 1997

The object of the invention is to provide a polishing machine, which are capable of making the degree of plane higher. The polishing machine comprises: a polishing plate for polishing a work, which is pressed thereon, the polishing plate being capable of rotating; and a driving mechanism for rotating the polishing plate, characterized in that the driving mechanism is capable of rotating the polishing plate in one direction and the other direction. In the polishing machine, since the work is polished by rotating the polishing plate in the one direction, then rotating it in the other direction, slurry concentrated at a specific position of the work can be scattered, so that the work can be polished uniformly and the degree of plane can be higher.

U.S. Pat. No. 5,573,448

Inventor: Nakazima

Issued: Nov. 12, 1996

A template-type wafer polishing method in which a plurality of wafers are polished while they are fitted in the corresponding number of circumferentially spaced engagement holes in a template blank, with the backsides of the respective wafers held by a backing pad, wherein the backing pad has, in its one surface next to the template blank, a plurality of annular grooves each extending along a corresponding one of the engagement grooves in the template blank for relieving a stress concentrated on the peripheral edge of each wafer. The polished wafer is free from deformation, such as declination caused at the peripheral edge thereof due to stress concentration and, hence, has an extremely high degree of flatness. The backing pad and a method of making the same are also disclosed.

U.S. Pat. No. 5,788,560

Inventor: Hashimoto

Issued: Aug. 4, 1998

A backing pad for supporting semiconductor wafer allowing an advanced flatness of its mirror-polished surface even for large sized wafers. A backing pad 1 is smoothly finished on its wafer holding surface 1a, thereon a number of grooves 2, 2 . . . aligned in a lattice form and elongated toward the outer periphery of the backing pad 1. The backing pad is typically made of polyurethane poromerics internally including a number of isolated pores. All of the grooves 2 are equal in the width and depth, which are kept constant along their lengthy direction. Intergroove pitch is also kept constant over the entire wafer holding surface 1a. The backing pad 1 is enlarged in its diameter to allow simultaneous loading of a plurality of wafers W, W . . . .

U.S. Pat. No. 6,612,905

Inventor: Nguyen

Issued: Sep. 2, 2003

A method and apparatus for forming wafers of varying thickness'. The apparatus includes a template. The template is formed of a main disk including a plurality of cavities extending into a first side thereof and a backing plate positioned on a side of the main disk opposite the first side. Holding disks are moistened and positioned within respective cavities for releasably securing a wafer in the cavity. When the template is releasably secured to and rotatable with a rotating head and positioned such that the first side faces a lapping and polishing surface, wafers received by the cavities are lapped and polished upon rotation of the rotating head. A plurality of shims are selectively received within respective cavities between a base of the cavity and the holding disk for adjusting a depth of the cavity thereby adjusting an amount of a wafer to be lapped and polished. The shims have varying thickness' and are color coated, each color being representative of a predetermined thickness for the shim. A mylar layer is bonded to a side of the backing plate opposite the main disk. A liquid is provided atop the lapping and polishing surface upon rotation of the templates.

U.S. Pat. No. 6,645,049

Inventor: Nguyen

Issued: Nov. 11, 2003

An method and apparatus for forming wafers of varying thickness'. The apparatus includes a template. The template is formed of a main disk including a plurality of cavities extending into a first side thereof. Each cavity has notches cut in the walls thereof and a pattern etched in the base thereof. Holding disks are moistened and positioned within respective cavities for releasably securing a wafer in the cavity. A moistening liquid is dispensed and diffuses into the cavities via the notches cut in the walls and collects in the pattern etched on the base of the cavity thereby increasing the suctional force used to secure the holding disk. When the template is releasably secured within a cavity, rotatably connected to a rotating head and positioned such that the first side faces a lapping and polishing surface, wafers received by the cavities are lapped and polished upon rotation of the rotating head.

U.S. Pat. No. 6,666,948

Inventor: Nguyen

Issued: Dec. 23, 2003

An method and apparatus for forming wafers of varying thickness'. The apparatus includes a template. The template is formed of a main disk including a plurality of cavities extending into a first side thereof and a backing plate positioned on a side of the main disk opposite the first side. Holding disks are moistened and positioned within respective cavities for releasably securing a wafer in the cavity. When the template is releasably secured to and rotatable with a rotating head and positioned such that the first side faces a lapping and polishing surface, wafers received by the cavities are lapped and polished upon rotation of the rotating head. A plurality of shims are selectively received within respective cavities between a base of the cavity and the holding disk for adjusting a depth of the cavity thereby adjusting an amount of a wafer to be lapped and polished. The shims have varying thickness' and are color coated, each color being representative of a predetermined thickness for the shim. A mylar layer is bonded to a side of the backing plate opposite the main disk. A liquid is provided atop the lapping and polishing surface upon rotation of the templates.

U.S. Pat. No. 6,733,367

Inventor: Nguyen

Issued: May 11, 2004

The invention shows a workpiece template and a number of additional elements for forming wafers of varying thicknesses'. The template is formed of a main disk including a plurality of cavities extending through a main plate with either a frictionless material or a backing plate forming the cavity base. The template shows additional elements to aid in the lapping/polishing abrasive fluid movement in the form of spiraling channels moving across the top surface of the template. The channels can extend through the template cavity walls. Also shown are the improvement previously stated applied to a template having notched gear-like teeth for another type of lapping/polishing machine.

While these polishing apparatuses and methods may be suitable for the purposes for which they were designed, they would not be as suitable for the purposes of the present invention, as hereinafter described.

SUMMARY OF THE PRESENT INVENTION

A primary object of the present invention is to provide a CMP polishing pad dresser/conditioner with spinning islands or discs.

Another object of the present invention is to provide a CMP polishing pad dresser/conditioner with spinning islands or discs that conforms to any polishing machine, which is used in the Chemical Mechanical Polishing (CMP) process.

Yet another object of the present invention is to provide a CMP polishing pad dresser/conditioner with spinning islands or discs that can be used with any polishing process used in polishing any material or substrate.

Still yet another object of the present invention is to provide a CMP polishing pad dresser/conditioner with spinning islands or discs that can be used on any size/diameter of polishing head or polishing table diameter.

Another object of the present invention is to provide a CMP polishing pad dresser/conditioner with spinning islands or discs that be used on hard or soft polishing pads with various grit.

Yet another object of the present invention is to provide a CMP polishing pad dresser/conditioner with spinning islands or discs that can be manufactured of any material such as fiberglass compounds called G10, G11 or other suitable materials.

Still yet another object of the present invention is to provide a CMP polishing pad dresser/conditioner with spinning islands or discs whereby the number and positioning of the Spinning islands or discs can be any combination, depending on the particular application.

Another object of the present invention is to provide a CMP polishing pad dresser/conditioner with spinning islands or discs whereby raised or milled patterns or channels on the top of the spinning island or disc can be any design or pattern as determined upon a particular application.

Yet another object of the present invention is to provide a CMP polishing pad dresser/conditioner with spinning islands or discs that incorporates a unique layered or sandwich design that is instrumental in creating the spinning polishing island or disc concept.

Still yet another object of the present invention is to provide a CMP polishing pad dresser/conditioner with spinning islands or discs that can provide improved consistent polishing pad conditioning over the entire surface of the polishing pad.

Another object of the present invention is to provide a CMP polishing pad dresser/conditioner with spinning islands or discs that can be utilized to break-in a new polishing pad Yet another object of the present invention is to provide a CMP polishing pad dresser/conditioner with spinning islands or discs that can be used to apply the polishing pad so that it sticks more evenly/consistently to the platen or table.

Still yet another object of the present invention is to provide a CMP polishing pad dresser/conditioner with spinning islands or discs that can be used to warm up the pad before a new run.

Another object of the present invention is to provide a CMP polishing pad dresser/conditioner with spinning islands or discs that effectively reduces and cleans up CMP process run residues, particles, and slurry build up on the polishing pads.

Yet another object of the present invention is to provide a CMP polishing pad dresser/conditioner with spinning islands or discs that will increase the effective polishing pad lifecycle.

Still yet another object of the present invention is to provide a CMP polishing pad dresser/conditioner with spinning islands or discs that will increase the polishing pad consistency and polishing effectiveness and thereby improving the polishing results, and creating more uniform polished wafers.

Another object of the present invention is to provide a CMP polishing pad dresser/conditioner with spinning islands or discs that will improve the polishing pad nap more evenly across the entire polishing pad, creating a better polished wafer product.

Yet another object of the present invention is to provide a CMP polishing pad dresser/conditioner with spinning islands or discs that will save money for the CMP industry by improved polishing pad conditioning, longer polishing pad lifecycle, and better polished wafers.

Additional objects of the present invention will appear as the description proceeds.

The present invention overcomes the shortcomings of the prior art by providing a CMP polishing pad dresser/conditioner consisting of a bottom layer of fiberglass or other suitable material with round cavities or pockets machined into the surface of the material in various patterns and a top layer of the same material with holes matching the locations of the bottom layer cavities or pockets. The bottom layer has double side glue tape applied with a protective backing shield that is peeled off at mounting, thus allowing the tool to be easily attached to the polishing machine head or carrier. The matching round holes in the top layer are of slightly smaller diameter than the bottom layer cavities to permanently hold or contain the spinning islands or discs in the cavities upon assembly of the various layers. Mylar shims are placed in the bottom layer cavities and the spinning polishing islands are placed in the cavities or pockets on top of the shims. The shims facilitate the spinning of the polishing discs or islands, which are slightly less diameter that the cavity diameters to further facilitate the spinning feature. The top layer with the machining holes is glued to the bottom layer, thereby permanently containing the spinning islands in the pockets or cavities.

The foregoing and other objects and advantages will appear from the description to follow. In the description reference is made to the accompanying drawing, which forms a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawing, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWING FIGURES

In order that the invention may be more fully understood, it will now be described, by way of example, with reference to the accompanying drawing in which.

DESCRIPTION OF THE REFERENCED NUMERALS

Figure 1:
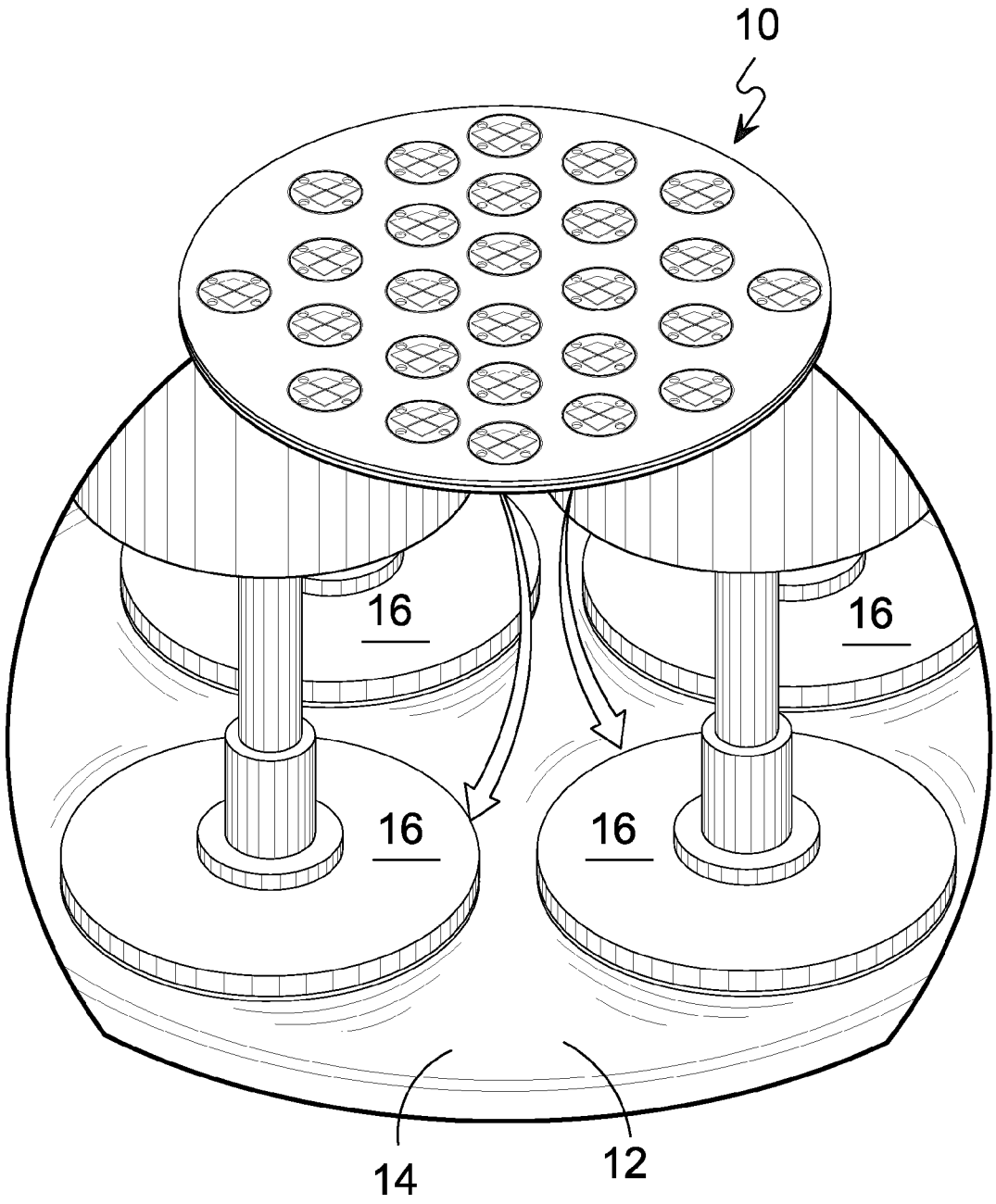
FIG. 1 is an illustrative view of the present invention in use.

Turning now descriptively to the drawings, in which similar reference characters denote similar elements throughout the several views, the Figures illustrate the method of constructing a catalog of the resources accessible through a network of the present invention. With regard to the reference numerals used, the following numbering is used throughout the various drawing figures.

10 Chemical Mechanical Polishing Pad Dresser of the Present Invention
12 lapping and polishing surface
14 slurry
16 polishing carrier
18 peelable removable adhesive cover
20 double sided adhesive layer
22 spinning island holder
24 spinning island holder aperture
26 shim
28 spinning island
30 spinning island aperture
32 spinning island extension
34 spinning island channels
36 spinning island retainer
38 spinning island retainer aperture
40 bonding

DETAILED DESCRIPTION OF THE PREFERRED EMBODIMENT

The following discussion describes in detail one embodiment of the invention (and several variations of that embodiment). This discussion should not be construed, however, as limiting the invention to those particular embodiments, practitioners skilled in the art will recognize numerous other embodiments as well. For definition of the complete scope of the invention, the reader is directed to appended claims.

Referring to FIG. 1, shown is an illustrative view of the present invention in use. The present invention is a chemical mechanical polishing pad dresser, conditioner or groomer 10, including methods for its use and manufacturing that incorporates built in or integrated spinning disc or islands, manufactured into pockets or cavities that are placed in various configurations on the surface of a polishing pad conditioning template or carrier 16. These spinning islands or discs are designed, embedded, and manufactured onto the surface of the polishing pad conditioning template or carrier in such a unique way as to permit them to spin freely during the polishing pad conditioning process 12 using slurry 14. The discs are designed with raised patterns of various designs that protrude above the surface of the spinning island and the polishing pad dresser carrier or template surface, to facilitate the pad dressing and conditioning process by creating a dynamic spinning effect of the strategically placed spinning islands or discs.

Figure 2:
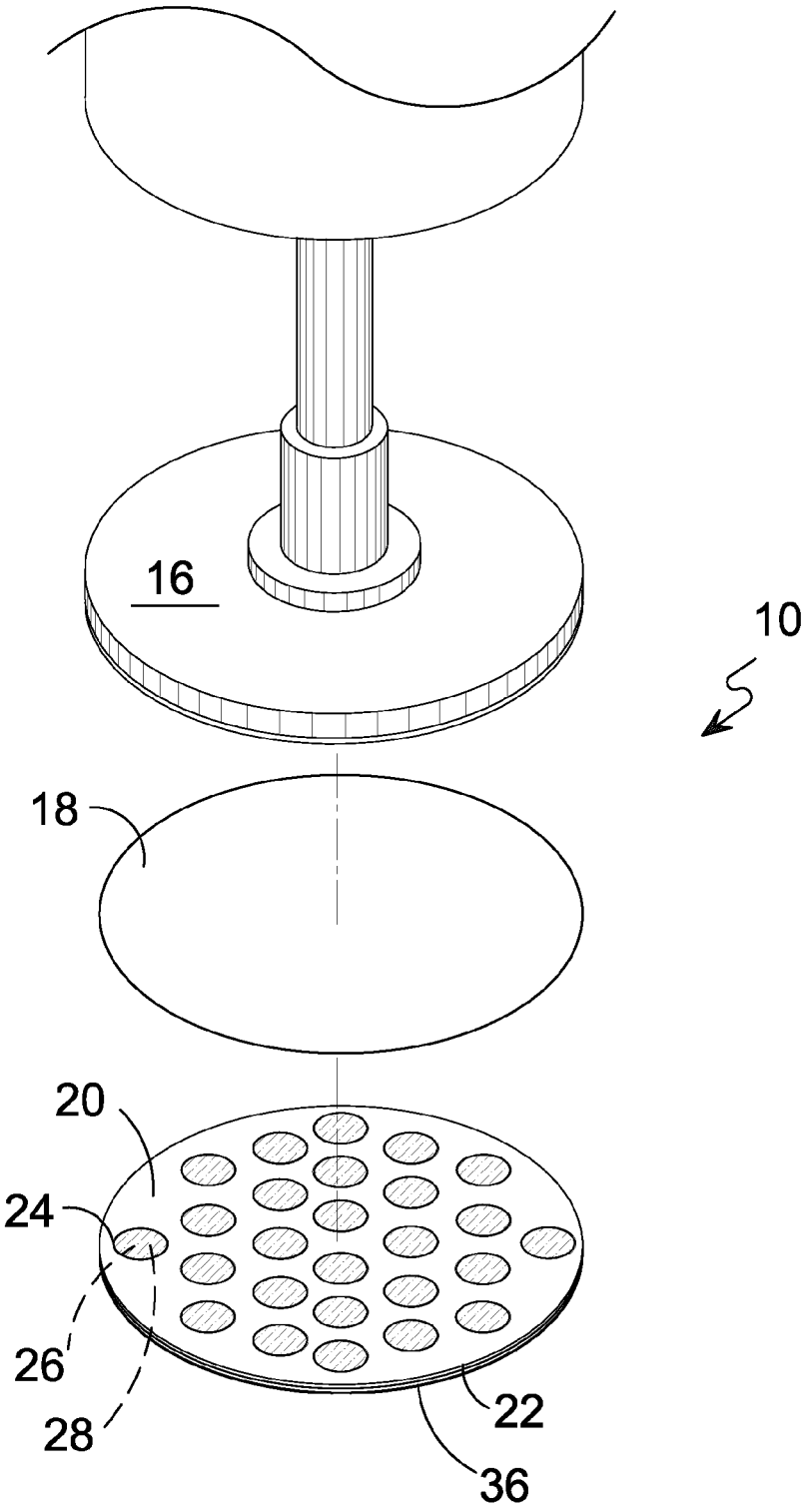
FIG. 2 is a perspective view of the present invention.

Referring to FIG. 2, shown is an exploded view of the present invention. Shown is the present invention, a chemical mechanical polishing pad dresser, conditioners or groomers 10 consisting of several integrated pieces and design components, layered in a sandwich type design. The superjacent layers 22, 36 are designed to the same dimensions as the polishing machine head 16. The device consists of layer 36 of fiberglass or other suitable material with round cavities or pockets 38 machined into the surface of the material in various patterns and layer 22 of the same material with apertures 24 matching the locations of the bottom layer cavities or pockets 38. Layer 22 has double side glue tape 20 applied with a protective backing shield 18 that is peeled off at mounting, thus allowing the tool to be easily attached to the polishing machine head or carrier 16. The coaligned apertures 24 in material layer 22 are of slightly smaller diameter than the layer 36 cavities 38 to permanently hold or retain the spinning islands or discs 28 in the cavities upon assembly of the various layers. Mylar shims 26 are placed in layer 22 cavities 24 and the spinning polishing islands 28 are placed in cavities or pockets 24 on top of the shims 26. The shims 26 facilitate the spinning of the polishing discs or islands 28, which are of slightly less diameter that the cavity diameter 24 to further facilitate the spinning feature. Layer 36 having apertures 38 is glued to the layer 22, thereby permanently containing the spinning islands 28 in the pockets or cavities.

Figure 3:
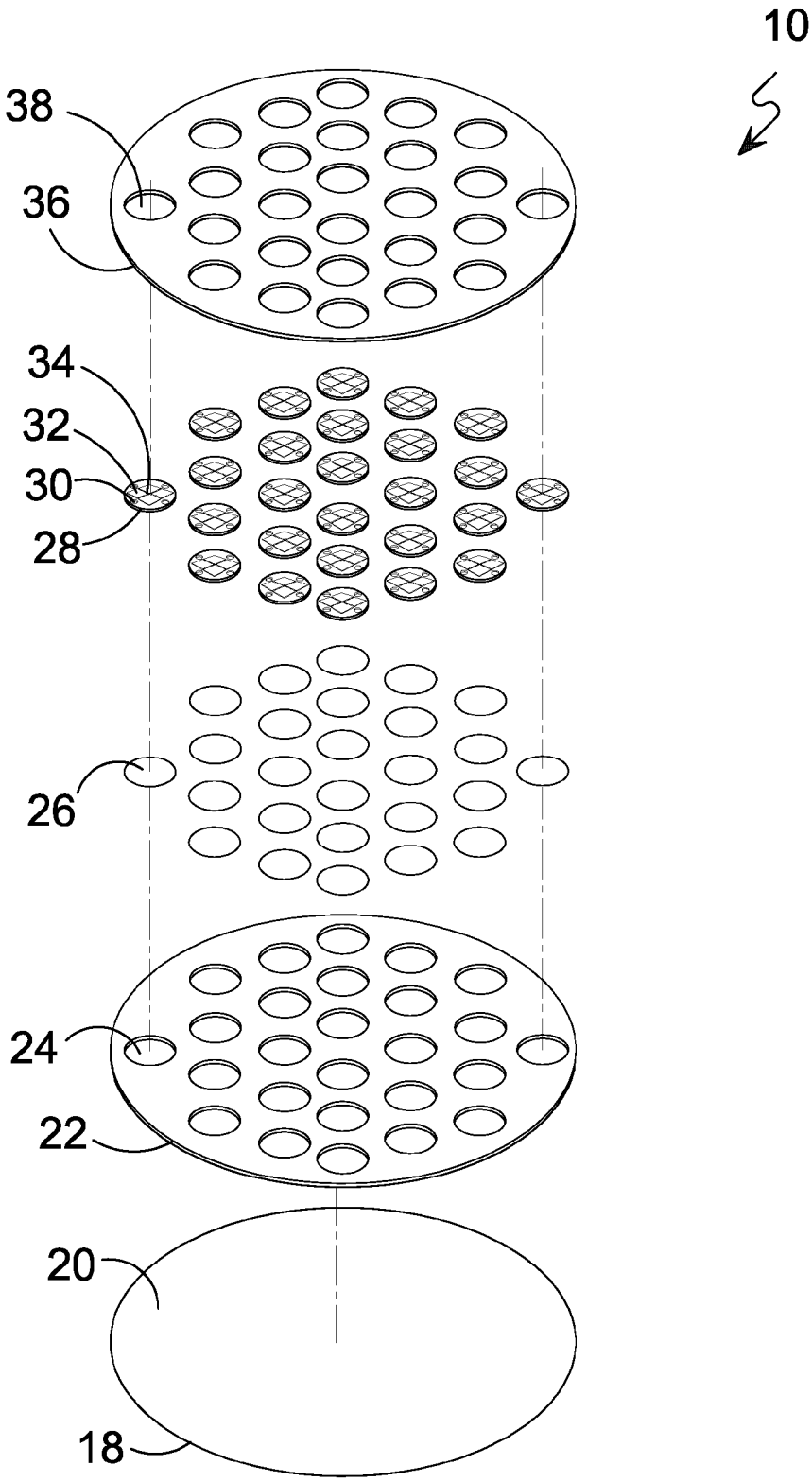
FIG. 3 is an exploded view of the present invention.

Referring to FIG. 3, shown is an exploded view of the present invention. Shown is an exploded view of the chemical mechanical polishing pad dresser, conditioners or groomers comprising a first layer of material 22 having at least one aperture 24 with an adhesive layer 20 with a peelable removable cover 18 positioned on one side of material layer 22. Also shown is shim 26 located within aperture 24 serving as a low coefficient of friction base element for rotative disk 28 positioned thereon. The second layer of material 36 having at least one aperture 38 that coaligns with aperture 24 once assembled. Aperture 38 is dimensionally smaller than material layer 22 aperture 24 and of that of rotative disk 28 thereby permanently retaining spinning disk 28 within aperture 24 of material layer 22. Rotative disk 28 has depending structure 32 which extends through and beyond aperture 38 of material layer 36 once assembled. The spinning island extension 32 has channels 34 and apertures 30 to facilitate movement of an abrading liquid used therewith.

Figure 4:
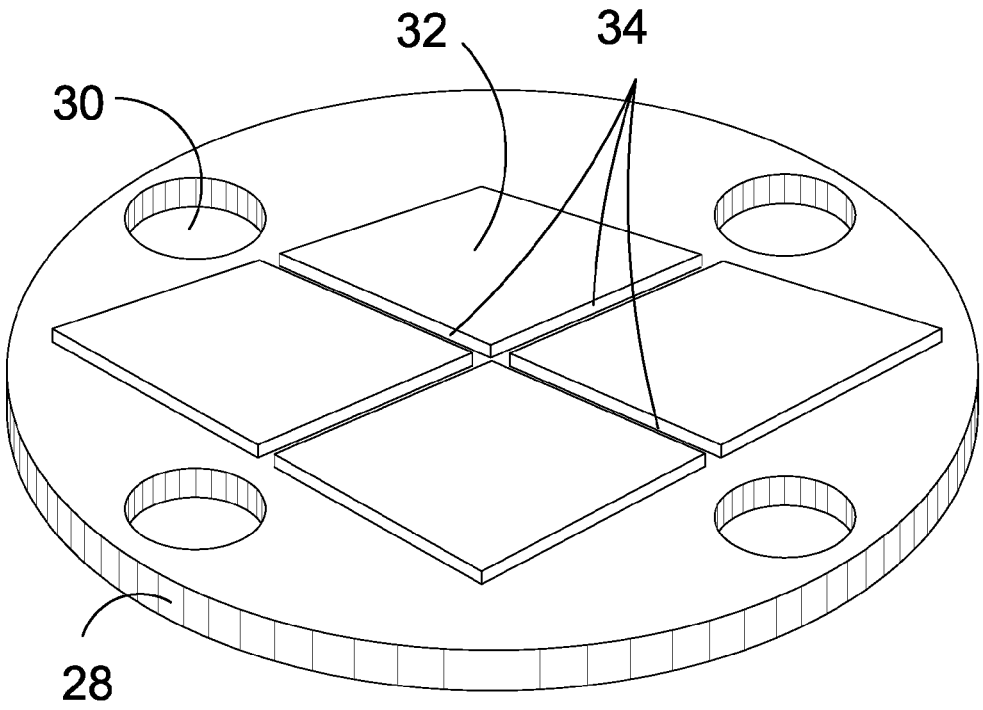
FIG. 4 is an exploded view of the present invention.

Referring to FIG. 4, shown is a detail view of the present invention's spinning island/disc. Shown is the present invention's spinning island/disc 28. The disc includes a polishing surface or a plurality of polishing surfaces 32 that may very in size and shape. The spinning discs also include a plurality of apertures 30 and channels 34 to provide means for the purging and cleaning of residual polishing slurry buildup in the spinning discs assembly including the shims and cavity areas underneath.

Figure 5:
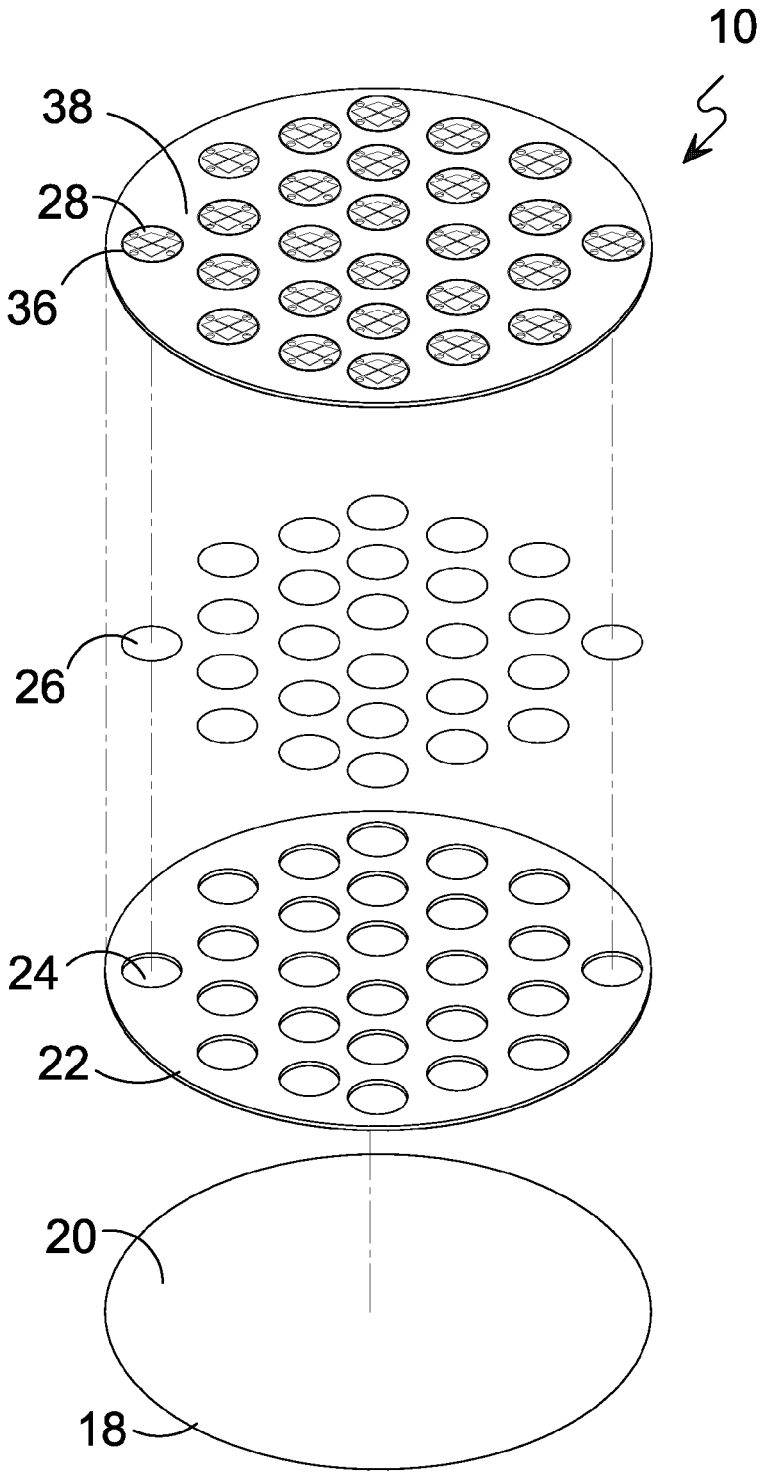
FIG. 5 is an exploded view of the present invention.

Referring to FIG. 5, shown is an exploded view of the present invention. Shown is a partially assembled view of the chemical mechanical polishing pad dresser, conditioners or groomers 10 comprising a first layer of material 22 having at least one aperture 24 with an adhesive layer 20 with a peelable removable cover 18 positioned on one side of material layer 22. Also shown is shim 26 located within aperture 24 serving as a low coefficient of friction base element for rotative disk 28 positioned thereon. The second layer of material 36 having at least one aperture 38 that coaligns with aperture 24 once assembled. Aperture 38 is dimensionally smaller than material layer 22 aperture 24 and of that of rotative disk 28 thereby permanently retaining spinning disk 28 within aperture 24 of material layer 22. Rotative disk 28 has depending structure 32 which extends through and beyond aperture 38 of material layer 36 once assembled. The spinning island extension 32 has channels 34 and apertures 30 to facilitate movement of an abrading liquid used therewith.

Figure 6:
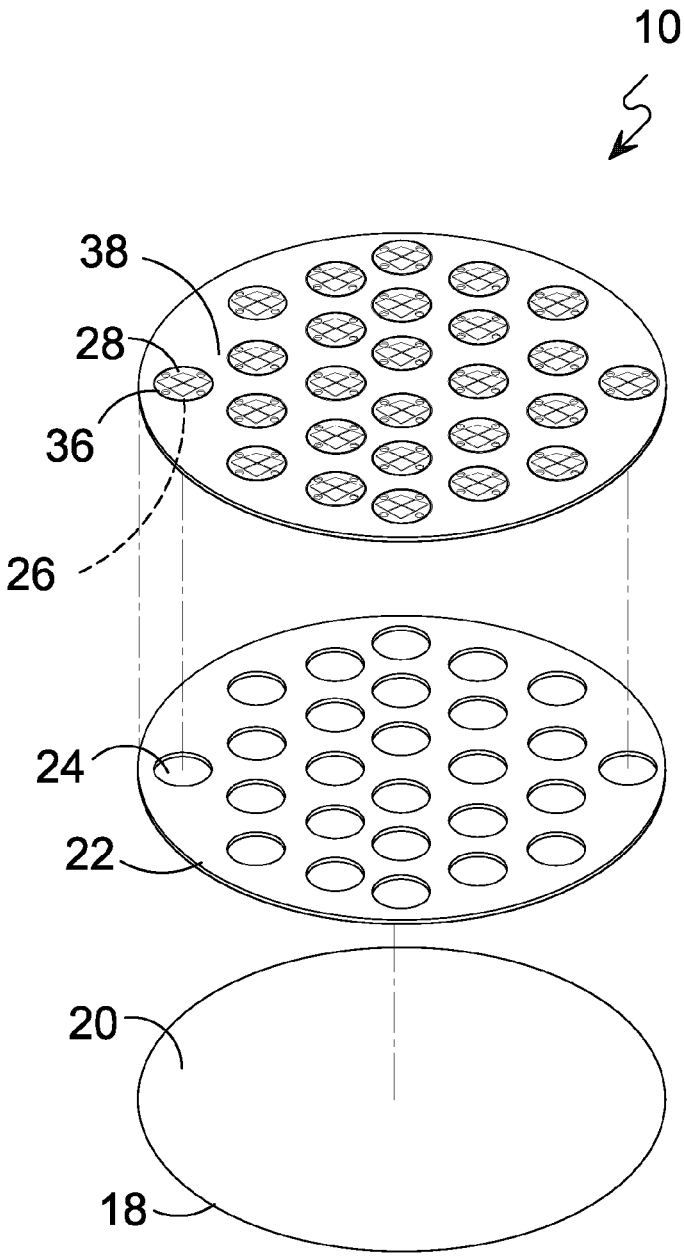
FIG. 6 is an exploded view of the present invention.

Referring to FIG. 6, shown is an exploded view of the present invention. Shown is a further partially assembled view of the chemical mechanical polishing pad dresser, conditioners or groomers 10 comprising a first layer of material 22 having at least one aperture 24 with an adhesive layer 20 with a peelable removable cover 18 positioned on one side of material layer 22. Also shown is shim 26 located within aperture 24 serving as a low coefficient of friction base element for rotative disk 28 positioned thereon. The second layer of material 36 having at least one aperture 38 that coaligns with aperture 24 once assembled. Aperture 38 is dimensionally smaller than material layer 22 aperture 24 and of that of rotative disk 28 thereby permanently retaining spinning disk 28 within aperture 24 of material layer 22. Rotative disk 28 has depending structure 32 which extends through and beyond aperture 38 of material layer 36 once assembled. The spinning island extension 32 has channels 34 and apertures 30 to facilitate movement of an abrading liquid used therewith.

Figure 7:
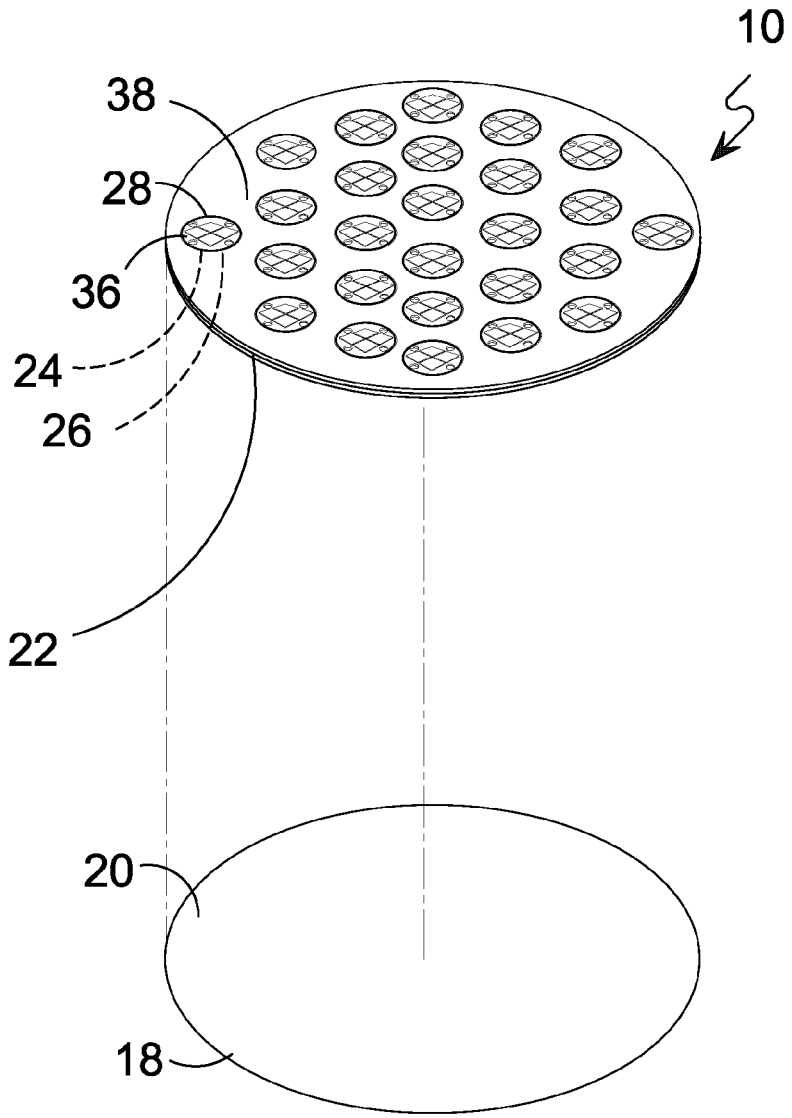
FIG. 7 is an illustrative view of the present invention in use.

Referring to FIG. 7, shown is an exploded view of the present invention. Shown is a further partially assembled view of the chemical mechanical polishing pad dresser, conditioners or groomers 10 comprising a first layer of material 22 having at least one aperture 24 with an adhesive layer 20 with a peelable removable cover 18 positioned on one side of material layer 22. Also shown is shim 26 located within aperture 24 serving as a low coefficient of friction base element for rotative disk 28 positioned thereon. The second layer of material 36 having at least one aperture 38 that coaligns with aperture 24 once assembled. Aperture 38 is dimensionally smaller than material layer 22 aperture 24 and of that of rotative disk 28 thereby permanently retaining spinning disk 28 within aperture 24 of material layer 22. Rotative disk 28 has depending structure 32 which extends through and beyond aperture 38 of material layer 36 once assembled. The spinning island extension 32 has channels 34 and apertures 30 to facilitate movement of an abrading liquid used therewith.

Figure 8:
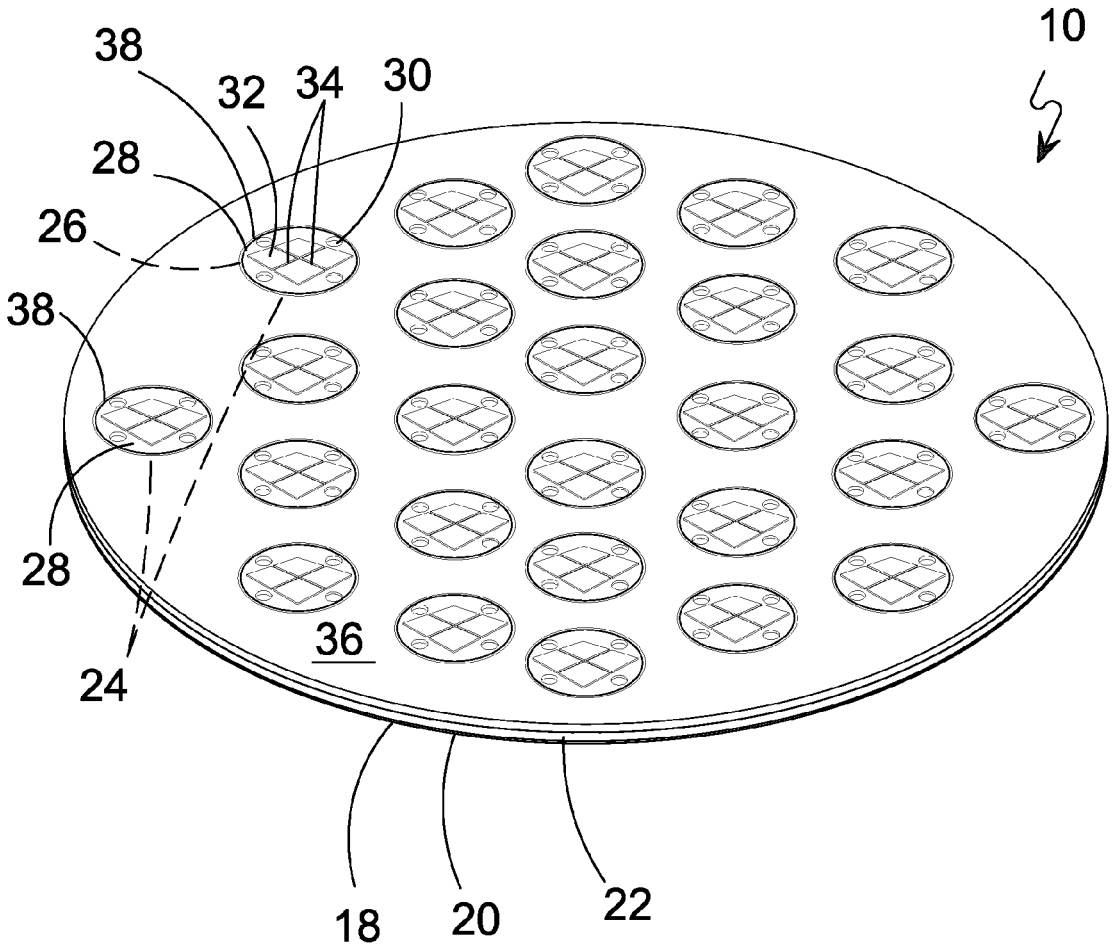
FIG. 8 is a sectional view of the present invention.

Referring to FIG. 8, shown is a perspective view of the present invention. Shown is a farther partially assembled view of the chemical mechanical polishing pad dresser, conditioners or groomers 10 comprising a first layer of material 22 having at least one aperture 24 with an adhesive layer 20 with a peelable removable cover 18 positioned on one side of material layer 22. Also shown is shim 26 located within aperture 24 serving as a low coefficient of friction base element for rotative disk 28 positioned thereon. The second layer of material 36 having at least one aperture 38 that coaligns with aperture 24 once assembled. Aperture 38 is dimensionally smaller than material layer 22 aperture 24 and of that of rotative disk 28 thereby permanently retaining spinning disk 28 within aperture 24 of material layer 22. Rotative disk 28 has depending structure 32 which extends through and beyond aperture 38 of material layer 36 once assembled. The spinning island extension 32 has channels 34 and apertures 30 to facilitate movement of an abrading liquid used therewith.

Figure 9:
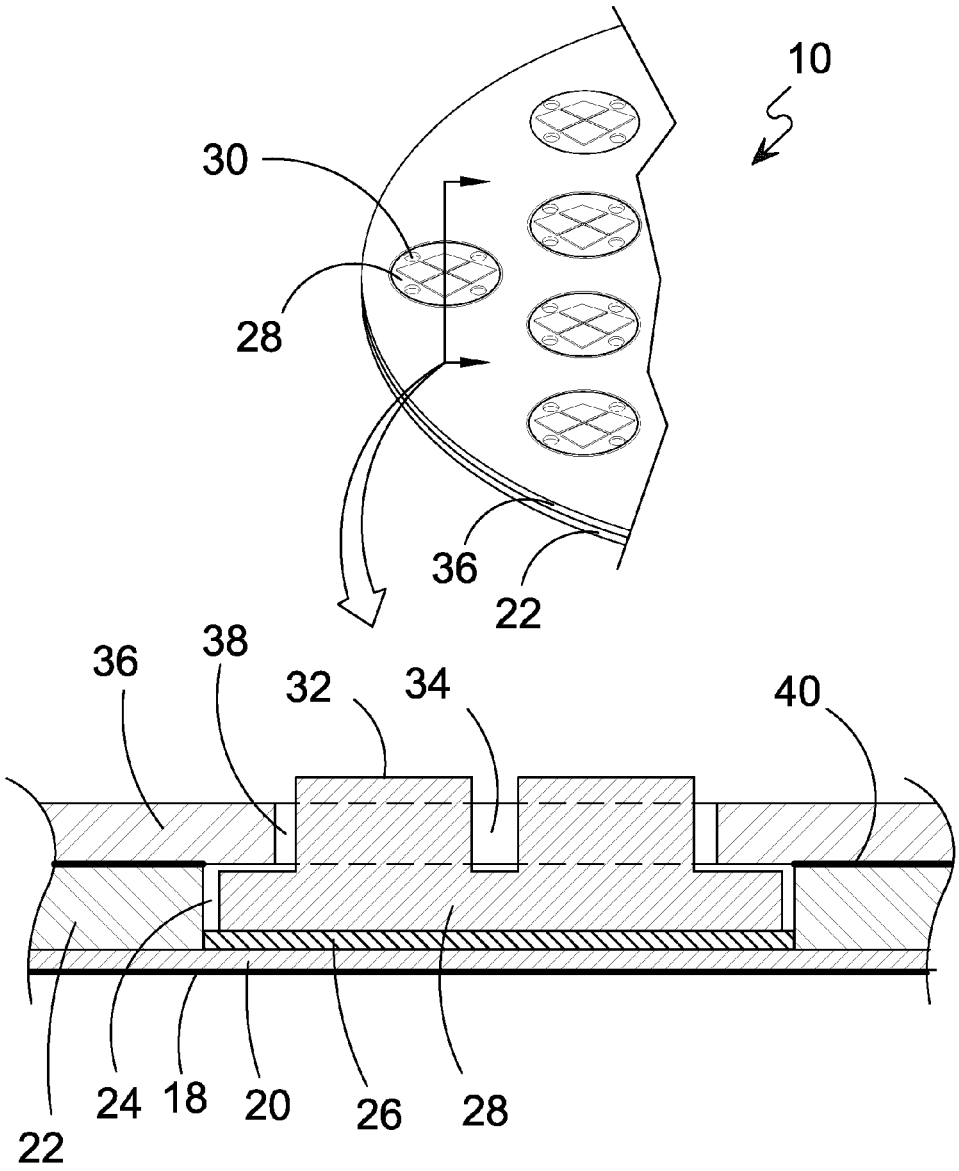
FIG. 9 is a detail view of the present invention's spinning island/disc.

Referring to FIG. 9, shown is a sectional view of the present invention. Shown is the present invention, a chemical mechanical polishing pad dresser, conditioners or groomers 10 consisting of several integrated pieces and design components, layered in a sandwich type design. The superjacent layers 22, 36 are designed to the same dimensions as the polishing machine head 16. The device consists of layer 36 of fiberglass or other suitable material with round cavities or pockets 38 machined into the surface of the material in various patterns and layer 22 of the same material with apertures 24 matching the locations of the bottom layer cavities or pockets 38. Layer 22 has double side glue tape 20 applied with a protective backing shield 18 that is peeled off at mounting, thus allowing the tool to be easily attached to the polishing machine head or carrier 16. The coaligned apertures 24 in material layer 22 are of slightly smaller diameter than the layer 36 cavities 38 to permanently hold or retain the spinning islands or discs 28 in the cavities upon assembly of the various layers. Mylar shims 26 are placed in layer 22 cavities 24 and the spinning polishing islands 28 are placed in cavities or pockets 24 on top of the shims 26. The shims 26 facilitate the spinning of the polishing discs or islands 28, which are of slightly less diameter that the cavity diameter 24 to further facilitate the spinning feature. Layer 36 having apertures 38 is glued to the layer 22, thereby permanently containing the spinning islands 28 in the pockets or cavities.

It will be understood that each of the elements described above, or two or more together may also find a useful application in other types of devices differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A chemical mechanical polishing pad dresser and conditioner comprising:

a) a first layer of material having at least one first aperture therethrough;

b) a second layer of material having at least one second aperture therethrough, said at least one first aperture being smaller than said second at least one second aperture;

c) a shim located within each of said at least one second aperture;

d) a disk of smaller dimension positioned in contact with each shim, each disk rotatable on its respective shim and rotatable within its respective second aperture;

e) said first layer joined to said second layer such that said at least one first aperture is coaligned with said at least one second aperture and each disk is rotatively retained within its respective second aperture; and f) a double faced adhesive layer having a peelably removable layer, said adhesive layer fastened to one side of the second layer.

2. The chemical mechanical polishing pad dresser and conditioner of claim 1, wherein the disk has a depending structure that extends through and beyond the layer of material having the smaller aperture.

3. The chemical mechanical polishing pad dresser and conditioner of claim 2, wherein said depending structure has channels placed therein for channeling of abrading fluid therethrough.

4. The chemical mechanical polishing pad dresser and conditioner of claim 3, further comprising at least one aperture located adjacent the depending structure for aiding in the movement of an abrading liquid.

5. The chemical mechanical polishing pad dresser and conditioner of claim 4, wherein the depending structure is of varied shape and size.

6. The chemical mechanical polishing pad dresser and conditioner of claim 5, wherein the polishing pad dresser and conditioner is sized to adhesively mount to any polishing head.

7. The chemical mechanical polishing pad dresser and conditioner of claim 6, wherein the polishing pad dresser and conditioner is sized for use with any chemical polishing machine.

8. The chemical mechanical polishing pad dresser and conditioner of claim 5, wherein the layers of material are manufactured of fiberglass compounds selected from the group consisting of G10 and G11.

9. The chemical mechanical polishing pad dresser and conditioner of claim 8, said at least one first aperture is a plurality of first apertures and said at least one second aperture is a plurality of second apertures.

10. The chemical mechanical polishing pad dresser and conditioner of claim 9, wherein the disks are predeterminedly positioned depending on the particular application.

11. The chemical mechanical polishing pad dresser and conditioner of claim 9, wherein the polishing pad dresser and conditioner incorporating the disks provides for a more evenly and consistent polishing pad conditioning over the entire surface of the polishing pad.

12. The chemical mechanical polishing pad dresser and conditioner of claim 9, wherein the polishing pad dresser and conditioner incorporating the disks is used for applying the polishing pad more evenly and consistently to the platen or table.

13. The chemical mechanical polishing pad dresser and conditioner of claim 9, wherein the polishing pad dresser and conditioner is designed to effectively reduce and clean up CMP process run residues, particles and slurry build up on the polishing pad.

14. The chemical mechanical polishing pad dresser and conditioner of claim 9, wherein the polishing pad dresser and conditioner incorporating the disks will increase the polishing pad consistency and polishing effectiveness improving the polishing results, and thereby creating more uniform polished wafers.

15. The chemical mechanical polishing pad dresser and conditioner of claim 9, wherein the polishing pad dresser and conditioner incorporating the disks will be cost effective for the CMP industry by providing improved polishing pad conditioning, longer polishing pad lifecycle, and better polished wafers.

16. A polishing pad comprising:

a) a first layer of material having a plurality of first apertures therethrough;

b) a second layer of material having a plurality of second apertures therethrough, said first apertures being smaller than said second apertures;

c) a shim located within each of said second apertures;

d) a disk positioned in contact with each shim, each disk rotatable on its respective shim and rotatable within its respective second aperture;

e) said first layer joined to said second layer such that said plurality of first apertures are coaligned with said plurality of second apertures and each disk is rotatively retained within its respective second aperture; and f) a double faced adhesive layer having a peelably removable layer, said adhesive layer fastened to a one side of the second layer.

17. The polishing pad of claim 16, wherein each disk has a depending structure that extends through and beyond said first layer.

18. The polishing pad of claim 17, wherein each said depending structure has channels placed therein for channeling of abrading fluid therethrough.

19. The polishing pad of claim 18, wherein each disk having at least one aperture located adjacent said depending structure for aiding in the movement of an abrading liquid.

20. The polishing pad of claim 16, wherein the first and second layers are made of fiberglass compounds selected from the group consisting of G10 and G11.

* * * * *